United States Patent [19]

Ruppert

[11] 3,991,833

[45] Nov. 16, 1976

[54] PILE HAMMER CUSHION APPARATUS

[76] Inventor: Robert W. Ruppert, 242 Globe Ave., Union, N.J. 07083

[22] Filed: Nov. 20, 1974

[21] Appl. No.: 525,479

[52] U.S. Cl. ..... 173/20; 173/131

[51] Int. Cl.[2] ..... E02D 7/06

[58] Field of Search ..... 61/53.5, 53.7; 173/131, 173/20; 73/11, 84; 116/114 AH, 34; 267/161, 162

[56] References Cited

UNITED STATES PATENTS

| | | | |
|---|---|---|---|
| 1,495,968 | 5/1924 | Whitney | 173/131 |
| 1,943,420 | 1/1934 | Budd | 61/53.5 |
| 2,000,688 | 5/1935 | Burr et al. | 267/162 |
| 2,295,489 | 9/1942 | Riemenscmneider | 173/131 |
| 2,723,532 | 11/1955 | Smith | 61/53.5 |
| 2,798,363 | 7/1957 | Hazak et al. | 173/131 |
| 2,912,564 | 11/1959 | Deffenbaugh et al. | 267/162 |
| 3,058,341 | 10/1962 | Heintzmann | 116/DIG. 34 |
| 3,417,828 | 12/1968 | Duyster et al. | 61/53.5 |
| 3,446,293 | 5/1969 | Guild et al. | 173/131 |
| 3,498,391 | 3/1970 | Guild et al. | 173/131 |
| 3,602,186 | 8/1971 | Popenol | 116/DIG. 34 |
| 3,759,351 | 9/1973 | Purple | 267/162 |
| 3,773,152 | 11/1973 | Sitton | 267/162 |
| 3,791,463 | 2/1974 | Pearson | 173/131 |
| 3,918,301 | 11/1975 | Baer | 267/162 |

FOREIGN PATENTS OR APPLICATIONS

| | | | |
|---|---|---|---|
| 612,779 | 1/1961 | Canada | 267/162 |

*Primary Examiner*—Paul R. Gilliam
*Assistant Examiner*—Alex Grosz
*Attorney, Agent, or Firm*—Richard L. Cannaday

[57] ABSTRACT

Apparatus is disclosed for cushioning or attenuating the highly destructive, peak impact forces which occur between an operating pile hammer ram and the pile cap or helmet at the moment of initial contact while permitting a maximum of the delivered energy to be converted into useful work in driving the pile. Such impact forces, which can physically damage the pile hammer, the helmet, the pile, or all three, are effectively and efficiently reduced by means of an energy storing, flat spring member. Said member is so arranged as to permit a determinable, relatively constant portion of the energy absorbed from the hammer blow to be stored during hammer deceleration and then be returned to the hammer ram on its retraction stroke while minimizing that portion of absorbed energy which is irrecoverably converted to heat.

24 Claims, 6 Drawing Figures

PILE HAMMER CUSHION APPARATUS

BACKGROUND OF THE INVENTION

1. Field of the Invention

With reference to the classifications of art established in the United States Patent Office, the substance of the present invention pertains to the general class "Hydraulic and Earth Engineering" (Class 61) and in particular to subclass "Piles" thereunder (Sub 53) and other subclasses as they may incorporate the materials once in and otherwise appropriate to now-discontinued Subclass 77.

2. Description of the Prior Art

In the operation of driving piles a so-called cushion is commonly used for prevention of physical damage to the hammer and/or the pile and pile follower apparatus caused by the repetitive, high impact induced stresses resulting from substantially instantaneous deceleration of the massive hammer ram from its high initial velocity. Under certain conditions secondary shock loads may occur due to pile rebound against the hammer. Other purposes of a cushion are to correct for slight misalignment between hammer and pile axes and to help assure full area contact between the striking surfaces.

It is rather common practice to use wood blocks or chips contained in a metal cylinder or helmet as a cushion means. However, wood in either block or chip form absorbs and retains a relatively large portion of the delivered energy and quickly becomes compacted; burns, and often must be replaced or replenished numerous times during the course of an operating day at the cost of operating continuity. In addition, the quantities of energy non-productively extracted or absorbed by wood cushions vary unpredictably during the course of hammering operations, and thus the allowances made or to be made for them are uncertain. This can result in inaccurate determinations of the pile bearing capacity when such determinations are calculated by assuming the hammer energy transferred to the pile through the cushion to be a known, fixed quantity.

Other forms of cushioning means are found in practice such as multilayered stacks of metal discs, stacks of alternating discs of aluminum and micarta, coils of metal cable, and other materials. By and large almost all of the known cushioning means actually used have been developed through trial and error methods including using practically any compressible materials at hand on a construction site. Although they may be workably adequate they are less than fully satisfactory.

Among the several patents showing cushion apparatus in the general area of the present invention are U.S. Pat. No. 1,943,420 to R. D. Budd, U.S. Pat. No. 2,184,745 to W. P. Kinneman, U.S. Pat. No. 2,723,532 to E. A. Smith, and U.S. Pat. No. 3,489,229 to P. Uebel et al. In the art disclosed by those patents one or more flat springs as hereinafter described and defined in the particular form of disc springs are used to absorb hammer energy. However, neither methods nor means for limiting disc deflection to minimize fatigue effects nor for containing the springs to avoid rebound, seal out dirt and harmful contaminants, promote lubrication and retain lubricants are taught. To be practical and efficient under field conditions a cushion utilizing spring elements is desirably self-contained or at least not comprised altogether of loose components; not susceptible to rebounding and possibly falling back out of working alignment; capable of giving reasonably long service and withstanding exposure to many kinds of adverse environmental influences or effects such as sand, dust, rain and snow, and needful of little or no attention. Also, means to indicate spring failure is highly desirable.

GENERAL THEORETICAL CONSIDERATIONS

To provide an improved and satisfactory pile hammer cushion, the present invention contemplates the use of one or more "flat" springs which for purposes of the present invention mean that kind of spring in which resistive and/or restoring forces are brought about by developing principal working stresses of the tensile and compressive mode in the spring material. This is in contrast to stressing the spring material principally in the torsional mode wherein the spring's resilient properties are a function of the modulus of elasticity in shear of the spring material. That modulus is ordinarily less than half the modulus of elasticity in compression and/or tension for customarily used materials. Known embodiments of flat springs include but are not necessarily limited to leaf springs, conical disc springs, spherical and cylindrical segment disc springs, and wave springs. Such springs are distinguishable as a class from torsion bar, helical, or coil springs which are representative of springs of the torsionally or shear stressed class. Springs of the latter class have a relatively lower spring rate (i.e. force vs. deflection ratio) for a given volume of material than those of the flat spring class and thus are not as appropriate for the concerned usage. For example, one conical disc spring of the so-called Belleville type used in an actual reduction to practice of the present invention requires an applied load of 81,000 pounds to produce a deflection of 0.125 inches and yet the approximate overall dimensions of that spring are only 10-inches diameter by 1-inch high. By contrast a single coil spring to exhibit a similar load/deflection ratio would be several times that size and would be substantially heavier.

Even a plurality of coil springs arranged in parallel such as found in punch and die assemblies would require too large an area to be practical for the present cushion application. It should be noted that multiple coil spring arrangements used in such assembles function solely to open the dies or die plates after the work stroke, and are so designed to offer a minimum of resistance during the closing or work stroke. That is in contrast to the present invention wherein it is desirable to provide a high initial resisting force for decelerating the hammer ram over a small distance to reduce impact. Belleville springs in most proportions can be calculated quite accurately, generally in accordance with analyses and equations developed by Almen and Laszlo, published in the *Transactions of the American Society of Mechanical Engineers*, May 1936.

Use of a flat, disc-type spring in a pile hammer cushion is a highly dynamic application thereof and fatigue effects should be considered in the design. A stress of 200,000 psi is a typical maximum working stress value for reasonably long cyclic life of springs of the Belleville type. Properly proportioned springs for pile hammer cushion applications may develop stresses in excess of that level if deflected to the fully flat condition. Therefore, the springs desirably should not be permitted to reach full deflection. When the number of load cycles is to be very high only fatigue tests on actual springs can determine the allowable working limits.

Both edge rounding and shot peening have been found helpful in increasing the fatigue life of disc springs. Surface scratches or other defects will reduce fatigue life by acting as stress raisers and sources for the beginning of cracks which will propagate rapidly, causing ultimate failure of the spring. Dirt, sand, or other foreign materials of abrasive nature must be kept away from the spring so as not to create surface defects. Springs are generally made of high carbon steel and therefore protection from corrosion is also important to fatigue life. Water and moisture should be prevented from reaching the spring. Plating or coatings such as cadmium, nickel or chromium plating; black oxide, electrogalvanizing, phosphate coating, and aluminizing can be used to resist corrosion.

With a conical disc spring, of which the Belleville spring is a particular kind, the maximum ratio of energy storage to spring weight is obtained when the outside diameter is approximately twice the inside diameter. The Belleville spring is defined at essentially that ratio of diameters. That is also approximately the ratio of diameters resulting in maximum flexibility and resiliency. The stiffness or spring rate (change in load per unit change in deflection) of conical disc springs can vary over the full range of deflection. A large variety of load/deflection characteristics can be obtained by changing the ratio of free height to disc thickness ($h/t$). For the present invention it is desirable that conical disc springs of the Belleville type have $h/t$ ratios in the range 0.4 to 1.6. As the $h/t$ ratio decreases, the load deflection curve approaches a straight line. At an $h/t$ value of 0.4 the maximum error in assuming a straight line load/deflection curve would be about 2.5 percent. When $h/t$ is greater than 1.41 the load reaches a peak prior to full deflection and then decreases with further deflection. If the $h/t$ ratio be greater than 2.83 the spring may snap through or turn inside out if deflected beyond the flat position. If springs be stacked in a series arrangement, as disclosed in U.S. Pat. No. 2,184,745 aforementioned, an $h/t$ ratio higher than 1.41 may cause snapping through. It is essential, therefore, that the design of the spring or springs be executed carefully to suit the energy characteristics of the particular pile hammer which they are intended to cushion.

SUMMARY OF THE INVENTION

The pile hammer cushion apparatus of this invention includes one of more flat springs, typically conical disc cushion springs, disposed between anvil plates or other impact sustaining or imparting means. Those anvil plates are joined together and held in relatively axially movable and guided relationship by means of at least one shoulder bolt. Small springs are provided under the heads of the shoulder bolts for applying a small initial preload on the cushion spring or springs, and also for absorbing recoil when the cushion spring is released after being compressed by a blow from a pile hammer. One anvil plate has a central boss for guiding and retaining the cushion spring. The spring-contacting surfaces of both anvil plates are shaped to conform to the cushion spring surfaces when that spring is flexed or compressed a predetermined amount which may be to fully flat condition but desirably not more than 90 percent of the spring's fully flat deflection. A skirt extends from one of the anvil plates and cooperates with a sealing member secured to the other anvil plate. A second sealing member is secured to that other anvil plate and cooperates with the inner cylindrical surface of the helmet. Those seals prevent dirt and other foreign materials including water from entering the cushion apparatus, and the skirt seal additionally retains lubricant which may be placed within the cushion spring cavity between the anvil plates.

In operation one of the anvil plates, generally an upper anvil plate, is struck by a pile hammer or hammer ram and moves under the force thereof compressing the cushion spring through a displacement which has been pre-determined in accordance with (1) the amount of energy to be absorbed and stored and (2) the maximum stress level permitted for a desired fatigue life. While traversing this displacement the spring resistance increases rapidly thereby decelerating the hammer ram and reducing impact or shock effect on the pile, the helmet and the ram. Upon reaching their full working displacement the anvil and spring surfaces are in full contact, and all remaining hammer ram energy is expended directly through the compressed cushion assembly to the helmet and through it to the pile being driven. On the retracting stroke of the ram the compressed cushion spring releases the bulk of its stored energy to the ram, thereby assisting the power medium (air, steam, etc.) in the retraction of the ram. A small fraction of the cushion spring's stored energy is converted into heat due to hysteresis and external friction effects and is not recovered. That loss amounts to approximately 3 percent of the spring's total stored energy for an unlubricated spring. Considerable reduction of external friction may be obtained by treating the cushion spring with dry film lubricants or with an extreme pressure lubricant. That is highly desirable if stacks of disc springs be used since the external friction loss is directly proportional to the number of spring surface interfaces.

The present invention may be summarized additionally, at least in part, by reference to its objects of which a number are given in the following statements.

It is an object of this invention to provide, and it does so provide, apparatus for the effective cushioning of pile hammer ram impacts which is more practical, reliable, and efficient than apparatus for that purpose known to the prior art.

It is a further object of this invention to provide, and it does so provide, apparatus for the effective cushioning of pile hammer ram impacts wherein and whereby a calculable and substantially constant amount of the delivered hammer energy is transferred to the pile during every blow of the hammer ram.

It is still a further object of this invention to provide, and it does so provide, apparatus for the effective cushioning of pile hammer ram impacts wherein a portion of the delivered hammer ram energy is stored in the cushion on each blow and then returned to the hammer ram on each retraction stroke thereof with negligible external friction and hysteresis loss.

It is an even still further object of this invention to provide, and it does so provide, apparatus for the effective cushioning of pile hammer ram impacts wherein at least one flat, disc-type cushion spring is held within a containment housing characterized by spring contact surfaces disposed to prevent said spring or springs from being deflected to their fully flat condition and including means for positioning, guiding, and lubricating said spring or springs, and sealing them from dirt and foreign materials.

As reduced to and employed in practice, the present invention effectively cushions the blows of a pile hammer ram while correspondingly reducing energy losses typically sustained with traditional cushions. Furthermore, the present invention makes it possible to know the amount of hammer energy delivered to the pile at and by every blow. That has not been possible, at least not easily possible, when using other, commonly employed cushion means.

BRIEF DESCRIPTION OF THE DRAWINGS

The nature and substance of the present invention as well as its objects and advantages will be more clearly perceived and fully understood by referring to the following description and claims considered in connection with the accompanying drawings in which:

DESCRIPTION OF THE PREFERRED EMBODIMENTS

Figure 1:
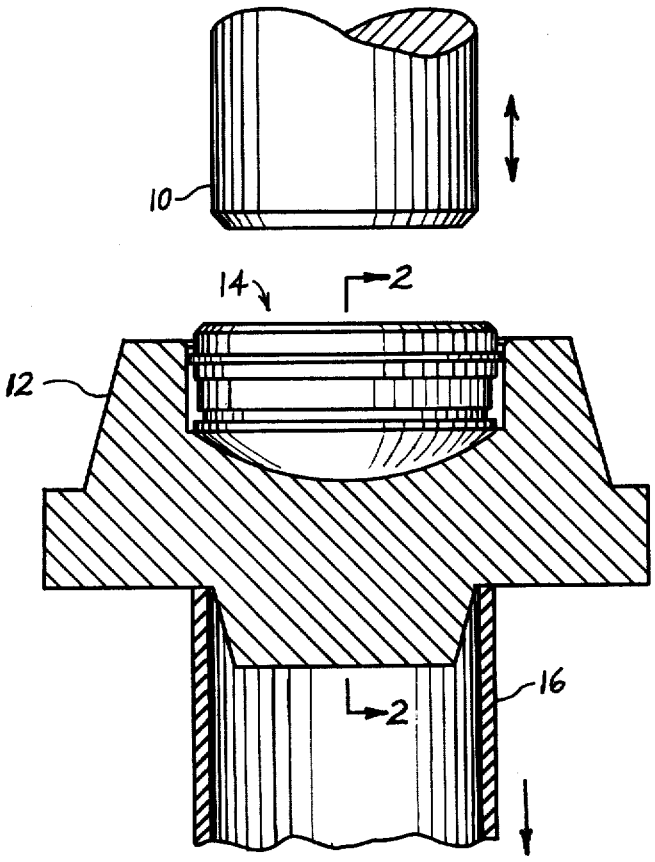
FIG. 1 is a side elevation view of a cushion apparatus according to the present invention shown in working relationship to a pile, pile helmet and pile hammer ram.

Referring now to the drawings in detail, especially to FIG. 1 thereof, 10 is a pile hammer ram-end; 12 is a typical pile helmet; 14 is an assembled pile hammer cushion apparatus according to the present invention fitted within the helmet, and 16 is a pile, shown as a pipe pile for example only, in and on which the helmet rests. For purposes of this description a helmet such as 12 shall be understood to mean broadly any suitable member disposed between the hammer ram and the top of a pile which serves to provide a space or means for containing, receiving or otherwise accommodating cushioning material or apparatus, and is itself capable of withstanding repetitive hammer ram impact.

Figure 2:
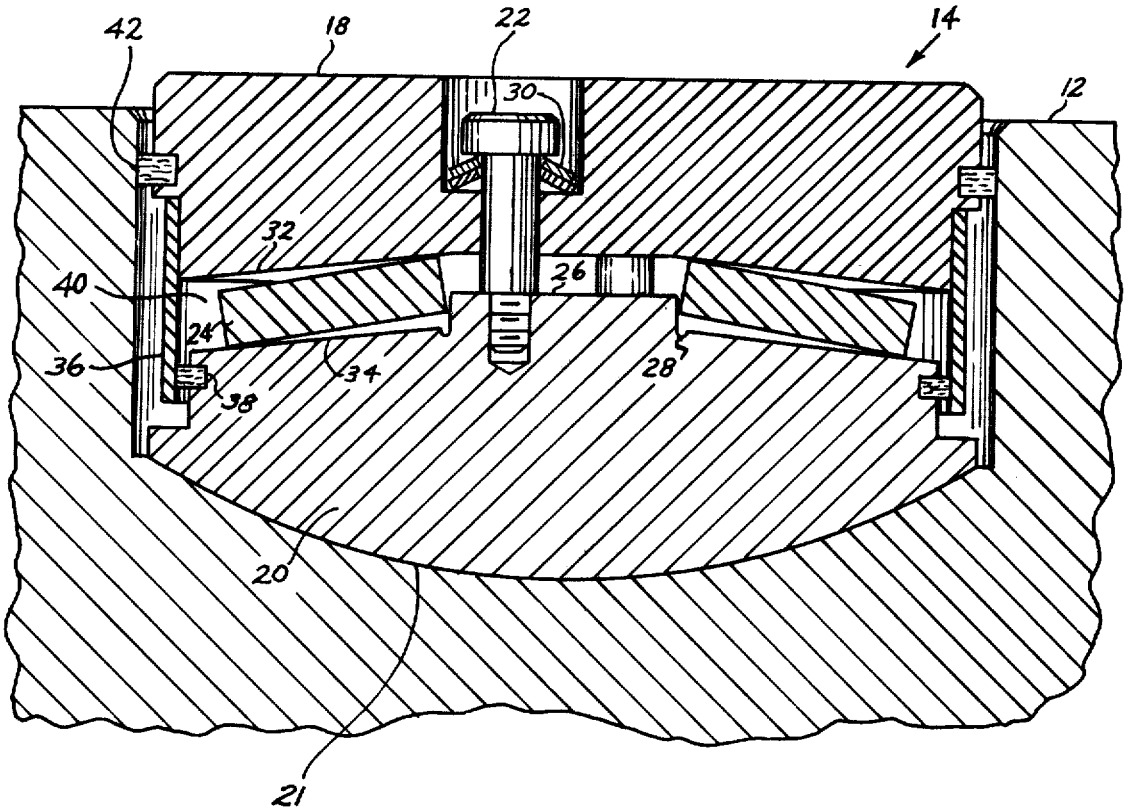
FIG. 2 is a sectional elevation view of the cushion apparatus of FIG. 1 taken along line 2—2 therein looking in the direction of the arrows.

Referring next to FIG. 2 together with FIG. 1, cushion apparatus 14 includes an upper anvil plate 18 which is slidably attached to lower anvil plate 20 by at least one shoulder bolt 22, two being shown. Those bolts are threaded into the lower anvil plate and secured there by means of thread locking compound or other known suitable locking means. Lower anvil plate 20 may be provided, as shown, with a spherically shaped bottom surface 21 for engagement with a similarly shaped inner top surface in helmet 12 to provide self-alignment between the hammer ram and helmet which rests on the pile. Alternatively and more simply the lower anvil plate and the helmet may have just substantially flat matching or mating surfaces. Disc-type cushion spring 24 is positioned between anvil plates 18 and 20 and held in proper side-to-side relationship to these parts by a centered boss 26 on the lower anvil plate which extends slidably upwardly through a central hole in the spring. A groove 28 is provided at the base of boss 26 for spring edge clearance and avoidance of stress concentrations in plate 20. Spring or springs 30, shown as disc-type springs, are provided beneath the heads of bolts 22 to absorb recoil shock of upper anvil plate 18 as cushion spring 24 flexes upwardly upon release of load from the upper anvil plate. Bolts 22 and springs 30 are so designed and arranged that in cushion apparatus 14 as assembled they apply a pre-load on cushion spring 24 through plate 18, in addition to that provided by the weight of the plate itself, to compensate for wear and/or permanent set which may occur in service.

Lower and upper surfaces 32 and 34 of anvil plates 18 and 20 respectively are so sloped and disposed that they limit the cushion spring flexure or displacement and make full contact with adjacent surfaces of spring 24 when that spring is deflected or compressed to a pre-determined limit of travel. That limit should desirably not be more than 90 percent of its fully flat displacement and preferably only somewhere between 40 percent and 75 percent of that displacement for good fatigue life of the cushion spring. However, surfaces 32 and 34 may be made flat, i.e., horizontal, if fatigue life be not of major concern.

A cylindrical skirt 36 is attached by welding or other suitable means to upper anvil plate 18 and extends downwardly to slidably engage seal ring 38 set in a circumferential groove in lower anvil plate 20. That sealing engagement acts to prevent entry of foreign materials into spring cavity 40 and to retain lubricant within that space. A seal ring 42 is installed similarly in and on upper anvil plate 18, and serves as a primary dirt exclusion means as it cooperates in slidable engagement with the inner cylindrical wall of helmet 12. Both seal rings 38 and 42 may be of any suitable, commercially available type. Skirt 36 may be made integral with upper anvil plate 18. Also, it may be installed in reversed arrangement, being attached to or made part of lower anvil plate 20 and engaging a seal ring installed in upper anvil plate 18.

Figure 3:
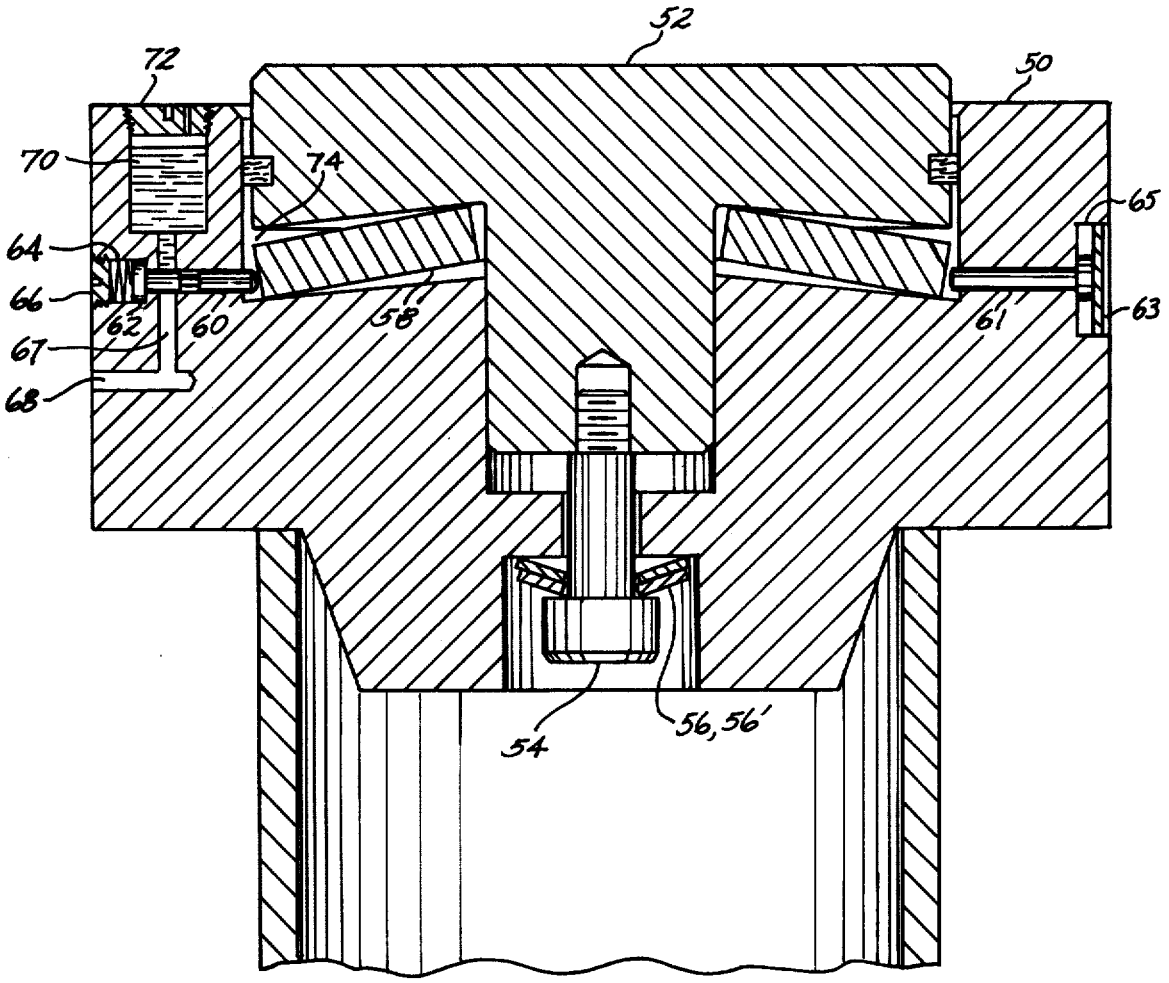
FIG. 3 is a sectional elevation view of another embodiment of a cushion apparatus according to the present invention wherein the lower anvil plate and the pile helmet are combined into a single unit and means are provided to indicate failure of the cushion spring.

Referring next to FIG. 3, another embodiment of the present invention is shown wherein helmet 50 is constructed to perform additionally the function of the previously described lower anvil plate 20. Modified upper anvil plate 52 includes a central guide post or portion which extends slidably downwardly into a receiving bore in the helmet. Shoulder bolt 54 passes upwardly through a suitable bore and counterbore in helmet 50, and is threaded into the aforementioned central guide post. There it is secured in suitable manner similarly to bolts 22. Disc springs 56, 56′ are provided between the head of bolt 54 and helmet 50 for a purpose as described previously for springs 30 in the apparatus of FIG. 2. Means for visually indicating failure of disc-type cushion spring 58 are provided including a rod 60 placed slidably in a radial hole in helmet 50 and extending inwardly to a point close to the outer periphery of spring 58. Rod 60 is provided with a head 62, backup spring 64 and retainer plug 66 threaded into the helmet, and it tends to be thrust toward cushion spring 58 by action of spring 64. There is a relatively short intermediate section of reduced diameter in rod 60 to provide a spool valve function.

In normal position as shown, rod 60 blocks off a passageway 67 leading upwardly from open port 68 to reservoir 70 defined in the helmet. That reservoir, closed at its top by a vented plug 72, is disposed to contain a liquid dye indicator. Failure of cushion spring 58, should it ever occur, will come in the form of a full depth radial crack running from that spring's inner to its outer periphery. The spring will then spread outwardly when flexed downwardly or compressed by subsequent hammer blows, that outward spread or movement being much greater than that which occurs when spring 58 is functioning in normal or uncracked condition. When cushion spring failure occurs rod 60 will be urged outwardly by the spreading spring thereby bringing the rod's section of reduced diameter into alignment with reservoir passageway 67 leading to port 68. Liquid dye will then flow from reservoir 70 escaping through port 68 and be detectable visually. Desirably, several liquid dye indicator systems of the kind just described are disposed around the helmet periphery to insure that failure indication will be given regardless of the circumferential or angular location of a crack in cushion spring 68.

The cushion spring failure indication system described above is but one of several systems which can take advantage of the displacement of a push rod extending into spring chamber 74. Other systems may employ electrical, pneumatic, hydraulic and/or mechanical signaling means according to selected arrangements, as desired and convenient, to accomplish the desired end result. For a particular mechanical arrangement shown in FIG. 3, a rod 61 slidably disposed in a horizontal passage or bore in helmet 50 can be displaced radially outwardly by undue spreading of cushion spring 58 to unseat a plug 63 pressed into a retaining bore 65 in the helmet. Unseating or popping out of plug 63 provides a signal of spring failure.

Figure 4:
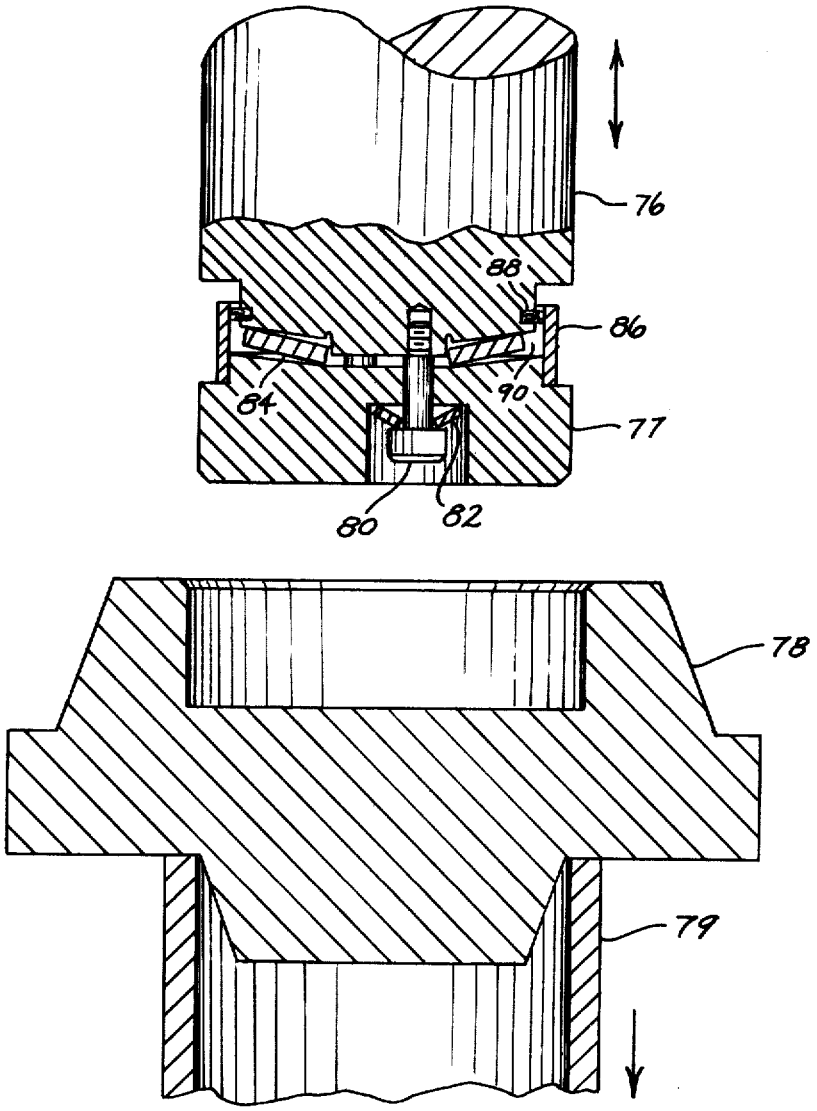
FIG. 4 is a sectional elevation view of another embodiment of a cushion apparatus according to the present invention wherein the upper anvil plate and the striking end of the pile hammer ram are combined into a single unit.

FIG. 4 shows another embodiment of the present invention wherein the cushion apparatus is installed directly on and to some extent includes the lower end of a pile hammer ram 76. Anvil plate 77 which impacts on a helmet or pile follower 78 set on pile 79 is guidedly attached to ram 76 by shoulder bolts 80 provided with recoil springs 82 of which one may be seen. Disc-type cushion spring 84 is contained between anvil plate 77 and the cooperatively configured adjacent surface of ram 76 which serves as an anvil surface. Skirt 86 on anvil plate 77 and seal ring 88 on the hammer ram cooperate to exclude foreign matter from spring cavity 90 throughout the range of displacement of the anvil plate relative to ram 76. It will be comprehended by those skilled in the art that with appropriate reversals of contour of the upper surface of anvil plate 77 and the bottom surface of hammer ram 76 the cushion spring 84 could be installed with an orientation similar to those of springs 24 and 58 of the embodiments of the present invention shown in FIGS. 2 and 3.

Figure 5:
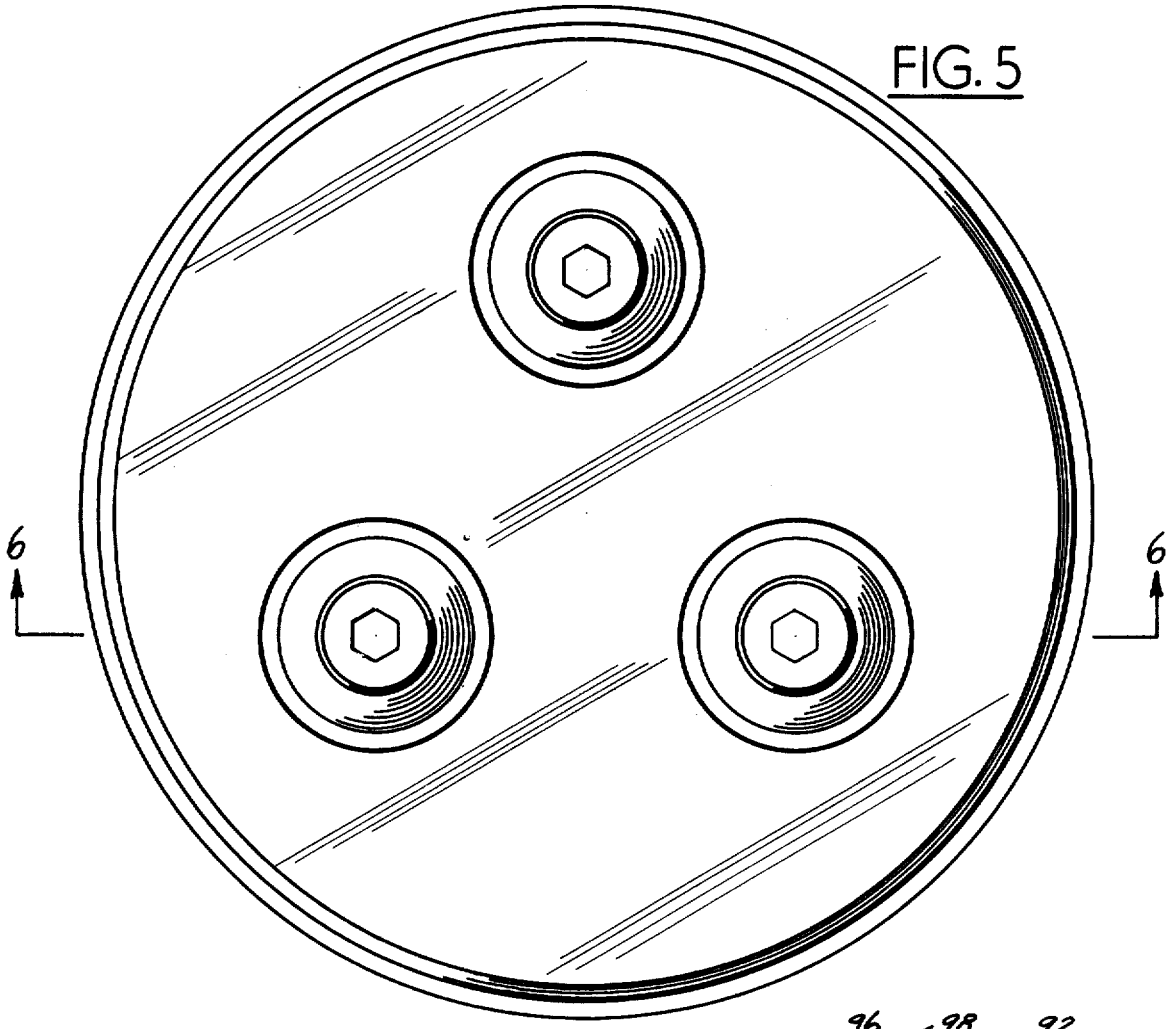
FIG. 5 is a plan view of another embodiment of a cushion apparatus according to the present invention wherein a plurality of cushion springs are provided in combined series-parallel arrangement.
Figure 6:
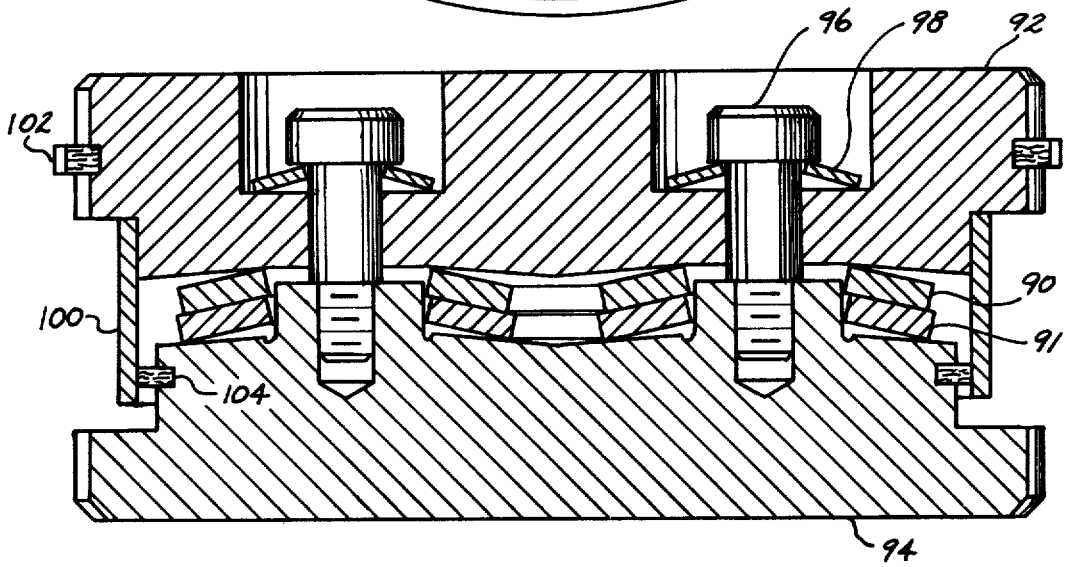
FIG. 6 is a sectional view of the cushion apparatus of FIG. 5 taken along line 6—6 therein looking in the direction of the arrows.

Finally, FIGS. 5 and 6 are a plan view and sectional elevation view respectively of another embodiment of the present invention employing a plurality of cushion spring groups, specifically three groups, each group as illustrated consisting of two cushion springs 90 and 91. The groups are equally spaced circumferentially and disposed at identical radii with respect to the upper and lower anvil plates 92 and 94. Although in each group only two cushion springs are shown stacked in serial array, a greater or lesser number may be used as either necessary or desirable in any particular instance depending upon size and space limitations and the overall spring load/deflection characteristica desired in each group and/or in the combination of groups collectively. So far as the arrangement of spring groups with respect to each other is concerned, a minimum of two may be used and still have a plurality of groups for development of parallel spring effects. Beyond that there may be three groups as shown, or any number greater than three depending upon space and size considerations, etc. Whatever number of groups be selected in a given instance, the particular geometrical distribution or arrangement actually used should be of a symmetrical nature. That will be true, of course, even if only a single cushion spring be present in each group so that just parallel spring effects and not parallel-series effects are developed. Shoulder bolts 96, recoil springs 98, skirt 100, and seals 102 and 104, all perform functions as hereinbefore described for corresponding elements of other embodiments of the present invention, especially the embodiment shown in FIGS. 1 and 2.

CONCLUSION

Protection by Letters Patent of this invention in all its aspects as the same are set forth in the appended claims is sought to the broadest extent that the prior art allows.

I claim as my invention:

1. A pile hammer cushion apparatus comprising (1) first and second anvil elements each characterized by an axis of impact, said elements being connected coaxially in a manner limiting movement of them away from each other, and (2) at least one flat spring located between said anvil elements tending normally to bias those elements into extended, spaced-apart relationship and being so disposed and configured to deflect resiliently and permit said anvil elements to be moved toward each other under external impact.

2. A pile hammer cushion apparatus according to claim 1 in which said first and second anvil elements are anvil plates.

3. A pile hammer cushion apparatus according to claim 1 in which one of said anvil elements is defined in a pile helmet.

4. A pile hammer cushion apparatus according to claim 1 in which one of said anvil elements is defined in a pile hammer ram.

5. A pile hammer cushion apparatus according to claim 1 in which said flat spring is a Belleville spring.

6. A pile hammer cushion apparatus according to claim 1 having a plurality of flat springs in parallel arrangement.

7. A pile hammer cushion apparatus according to claim 1 having a plurality of flat springs in series arrangement.

8. A pile hammer cushion apparatus according to claim 1 having a plurality of flat springs in parallel-series arrangement.

9. A pile hammer cushion apparatus comprising (1) first and second anvil elements each characterized by an axis of impact, said elements having facing surfaces from one to the other and being connected coaxially in a manner limiting movement of them away from each other, and (2) at least one Belleville spring located between the facing surfaces of said anvil elements tending normally to bias those elements into extended, spaced apart relationship and being so disposed and configured to deflect resiliently and permit said anvil elements to be moved toward each other under external impact with said facing surfaces being so contoured to prevent said spring from being driven to a fully flat condition.

10. A pile hammer cushion apparatus according to claim 9 in which said Belleville spring has a ratio of free height to disc thickness in the range 0.4 to 1.6.

11. A pile hammer cushion apparatus according to claim 9 in which the facing surfaces of said anvil elements are so contoured that said Belleville spring cannot be driven beyond 90 percent of its fully flat deflection.

12. A pile hammer cushion apparatus according to claim 9 in which the facing surfaces of said anvil elements are so contoured that said Belleville spring can be driven through at least 40 percent but not beyond 75 percent of its fully flat deflection.

13. A pile hammer cushion apparatus comprising (1) first and second anvil elements each characterized by an axis of impact, said elements being connected coaxially in a manner limiting movement of them away from each other; (2) at least one flat spring located between said anvil elements tending normally to bias those elements into extended, spaced-apart relationship and being so disposed and configured to deflect resiliently and permit said anvil elements to be moved toward each other under external impact, and (3) sealing means operable between said anvil elements throughout their whole range of movement toward and away from each other whereby foreign matter is prevented from entering between those elements.

14. A pile hammer cushion apparatus according to claim 13 in which said sealing means comprises (1) a seal ring disposed around an external surface of one of said anvil element and (2) a continuous skirt extending from the other of said anvil elements in rubbing contact with said ring.

15. A pile hammer cushion apparatus comprising (1) first and second anvil elements each characterized by an axis of impact; (2) means connecting said elements coaxially in a manner limiting movement of them away from each other, said means comprising (i) at least one columnar element fixedly established with respect to one of said anvil elements and extending therefrom parallel to the axis of impact thereof in sliding relation through and beyond the other of said anvil elements, and (ii) a head-like formation on said columnar elements in its extension beyond said other of said anvil elements, and (3) at least one flat spring between said anvil elements tending normally to bias those elements into extended, spaced-apart relationship and being so disposed and configured to deflect resiliently and permit said anvil elements to be moved toward each other under external impact.

16. A pile hammer cushion apparatus according to claim 15 in which said means connecting said anvil elements is a headed bolt threaded into said one of said anvil elements.

17. A pile hammer cushion apparatus according to claim 15 in which said means connecting said anvil elements comprises a plurality of said columnar elements having head-like formations thereon with those columnar elements being disposed in spaced relationship one to the other in a symmetrical arrangement.

18. A pile hammer apparatus comprising (1) first and second anvil elements each characterized by an axis of impact, said elements being coaxially in a manner limiting movement of them away from each other; (2) at least one flat spring located between said anvil elements tending normally to bias those elements into extended, spaced-apart relationship and being so disposed and configured to deflect resiliently and permit said anvil elements to be moved toward each other under external impact, and (3) resilient means acting upon at least one of said anvil elements tending normally to move those elements toward each other whereby a pre-load is maintained upon said flat spring.

19. A pile hammer cushion apparatus according to claim 18 in which said resilient means whereby a pre-load is maintained upon said flat spring comprises (1) at least one columnar element fixedly established with respect to one of said anvil elements and extending therefrom parallel to the axis of impact thereof in sliding relation through and beyond the other of said anvil elements; (2) a head-like formation on said columnar element in its extension beyond said other of said anvil elements, and (3) at least one resilient element retained between said head-like formation and said other of said anvil elements and so stressed thereby to tend to move said anvil elements toward each other.

20. A pile hammer cushion apparatus according to claim 19 in which said resilient element is a Belleville spring.

21. A pile hammer cushion apparatus comprising (1) first and second anvil elements each characterized by an axis of impact, said elements being connected coaxially in a manner limiting movement of them away from each other; (2) at least one flat spring located between said anvil elements tending normally to bias those elements into extended, spaced-apart relationship and being so disposed and configured to deflect resiliently and permit said anvil elements to be moved toward each other under external impact, and (3) means for providing warning of the failure of said flat spring, that means being sensitive to an undue lateral excursion of an outer edge of said flat spring.

22. A pile hammer cushion apparatus according to claim 21 in which said means for providing warning of the failure of said flat spring comprises a rod-like element slidably disposed in one of said anvil elements substantially radially with respect to the axis of impact thereof, having an inner end, and with the flat spring in an unfailed condition being retained so that its inner end is sufficiently close to an outer edge of said flat spring that that end will be borne upon by said outer edge and said rod-like element accordingly moved outwardly incidentally to undue lateral excursion of said outer edge characterizing failure of said flat spring.

23. A pile hammer cushion apparatus according to claim 22 in which said one of said anvil elements is characterized by a liquid reservoir having a passage leading therefrom to a visible exterior region of said one element and said rod-like element acts as a valve in said passage normally to prevent flow therethrough of liquid from said reservoir but to permit the same upon said rod-like element being moved outwardly incidentally to undue lateral excursion of said outer edge of said flat spring.

24. A pile hammer cushion apparatus according to claim 22 in which said one of said anvil elements is characterized by a bore in a visible exterior region thereof aligned with said rod-like element, said bore being normally closed by a plug element disposed to be borne upon and unseated by said rod-like element upon the latter being moved outwardly incidentally to undue lateral excursion of said outer edge of said flat spring.

* * * * *